US007470143B2

(12) United States Patent
Osborn, Jr. et al.

(10) Patent No.: US 7,470,143 B2
(45) Date of Patent: Dec. 30, 2008

(54) ELECTRICAL CONNECTOR COMPONENTS

(75) Inventors: Robert H. Osborn, Jr., Collierville, TN (US); Andrew C. Cole, Memphis, TN (US); James Michael Baker, Southaven, MS (US)

(73) Assignee: Thomas & Betts International, Inc., Wilmington, DE (US)

( * ) Notice: Subject to any disclaimer, the term of this patent is extended or adjusted under 35 U.S.C. 154(b) by 45 days.

(21) Appl. No.: 11/656,212

(22) Filed: Jan. 22, 2007

(65) Prior Publication Data

US 2007/0249215 A1 Oct. 25, 2007

Related U.S. Application Data

(60) Provisional application No. 60/793,436, filed on Apr. 20, 2006.

(51) Int. Cl.
*H01R 4/24* (2006.01)

(52) U.S. Cl. ..... 439/441; 439/438

(58) Field of Classification Search ..... 439/441, 439/440, 437, 438
See application file for complete search history.

(56) References Cited

U.S. PATENT DOCUMENTS

| | | | | |
|---|---|---|---|---|
| 3,646,582 | A | 2/1972 | Van Alphen et al. | |
| 3,688,243 | A * | 8/1972 | Yamada et al. | 439/293 |
| 3,977,751 | A | 8/1976 | Sahrbacker | |
| 4,036,545 | A | 7/1977 | Mysiak et al. | |
| 4,350,839 | A | 9/1982 | Lass | |
| 4,455,057 | A | 6/1984 | Mariani | |
| 4,461,527 | A | 7/1984 | Izraeli | |
| 4,566,748 | A | 1/1986 | Tanishi et al. | |
| 4,566,749 | A | 1/1986 | Johnston | |
| 4,585,902 | A | 4/1986 | Munroe | |
| 4,673,232 | A | 6/1987 | Kubota et al. | |
| 4,918,258 | A * | 4/1990 | Ayer | 174/53 |
| 5,019,674 | A | 5/1991 | Greene | |
| 5,149,279 | A | 9/1992 | Kruse | |
| 5,292,260 | A | 3/1994 | Sinisi et al. | |
| 5,454,730 | A | 10/1995 | Tozuka | |
| 5,519,171 | A | 5/1996 | Vester | |
| 5,529,522 | A | 6/1996 | Huang | |
| 5,626,488 | A | 5/1997 | Albeck et al. | |
| 5,760,332 | A | 6/1998 | Rocci et al. | |
| 6,257,919 | B1 | 7/2001 | Cutler et al. | |
| 6,280,233 | B1 | 8/2001 | Beege et al. | |
| 6,814,608 | B2 | 11/2004 | Kollmann | |
| 6,890,192 | B2 | 5/2005 | Riku | |
| 6,893,286 | B2 | 5/2005 | Drewes et al. | |
| 6,981,890 | B2 | 1/2006 | Cutler et al. | |
| 7,083,463 | B2 | 8/2006 | Steinkemper et al. | |
| 7,131,857 | B2 * | 11/2006 | Mueller | 439/441 |
| 2007/0091596 | A1 * | 4/2007 | Grossman et al. | 362/217 |

* cited by examiner

*Primary Examiner*—Tho D Ta
*Assistant Examiner*—Travis Chambers
(74) *Attorney, Agent, or Firm*—Hoffman & Baron, LLP

(57) ABSTRACT

A contact terminal is useful as an electrical disconnect. The contact terminal is generally of one-piece construction having a main body and a portion thereof cantilevered from this main body. This cantilevered portion is configured with a wire receiving apparatus so as to receive the wire therein and allow the wire to make both mechanical and electrical engagement with the contact terminal. The contact terminal is also configured with an embossment or stiffener adjacent the junction of the main body and the cantilevered portion so as to provide rigidity to the cantilevered portion when this portion is subject to a wire withdrawal force.

15 Claims, 3 Drawing Sheets

ELECTRICAL CONNECTOR COMPONENTS

CROSS-REFERENCE TO RELATED APPLICATIONS

This application claims priority to U.S. Provisional Application No. 60/793,436, filed Apr. 20, 2006.

FIELD OF THE INVENTION

This invention pertains to electrical connector components in general and particularly to electrical contact terminals with or without dielectric housing such as those as can be used in disconnects to de-energize or isolate fluorescent lamps and ballasts for servicing.

BACKGROUND OF THE INVENTION:

Industry standards are oftentimes established as a means of insuring the safety of the installer and for the end-user. Presently, it is anticipated that the National Electric Code (NEC) will begin implementing regulations requiring all fluorescent luminaries to have a means of electrically isolating their components so as to increase the safety of working on them or replacing their parts in the field. This new provision is intended to make standard the ability to safely disconnect various electrical components from both a power source as well as ground or neutral wiring. This requirement is expected to apply particularly to fluorescent tube lamps and their associated ballasts.

As can be appreciated, there are many different types of electrical connectors that can be disconnected. They are all quite capable of safely de-energizing or removing an electrical component from a circuit (power or ground) so that it may be serviced in confidence. Of course, while proper technique does not condone any pulling of the wires to separate the connector, this may be exactly what actually occurs. Pulling directly on the wires instead of the connector is likely to weaken the connection between the wire and the electrical contact within the connector. In some cases, the wire is soldered or crimped to the contact, in other cases the wire is simply inserted into an insulation displacement contact or pushed into the connector. Such mishandling (i.e. pulling on the wires instead of the connector) can cause these joints to separate. Obviously, then, these joints can not withstand this kind of mishandling, especially repeatedly as would occur in the life of a disconnect. The consequence being the separation of the wire from the contact terminal thereby rendering the connector unusable.

SUMMARY OF THE INVENTION

It is thus an object of the present invention to provide a new contact terminal design that is better at resisting such mishandling. It is a further object of this invention to improve upon those types of electrical connectors that can be disconnected. Such disconnects are often used to safely break or disrupt the electric circuit to a component being replaced or serviced. In some cases, the disconnect may be operated or employed quite frequently and hence it is a desire for this invention to be suitable for repeated use and some degree of mis-use. Thus, it is intended that this invention will be sturdy so that it can withstand repeated disconnections and re-connections by various workers without affecting its ability to provide a low resistance electrical connection.

It is also a purpose of this invention to provide a low-cost and easily implemented improvement to existing electrical connectors that can become readily available to those in the field so as to enhance their safety as well as comply with this new standard or regulation. These and other objects and advantages of this invention will be come apparent upon further investigation and review.

A contact terminal for an electrical connector, such as an electrical disconnect, that incorporates a main contact body having a portion thereof that is cantilevered away from this main contact body. The cantilevered portion is configured to receive a wire for electrical connection to the contact terminal. This portion is also configured with a stiffener located adjacent the junction of the main body and this portion, the stiffener providing rigidity to this junction and preventing deflection of the cantilevered portion should the wire be pulled.

BRIEF DESCRIPTION OF THE DRAWINGS

FIG. 7 is a perspective view of the male push-in contact terminal of FIG. 2 with a partial view of a wire prior to being pushed in;

Figure 1:
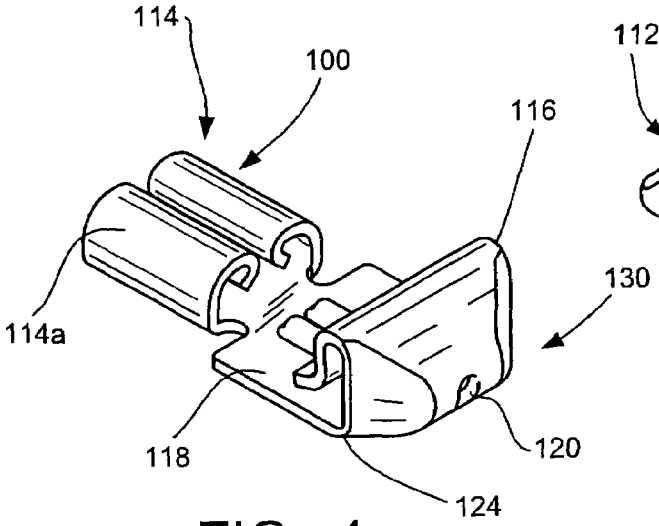
FIG. 1 is a perspective view of a female push-in contact terminal illustrating the invention.
Figure 2:
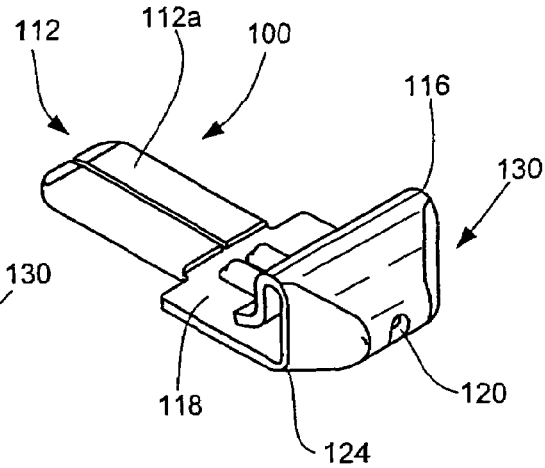
FIG. 2 is a perspective view of a male push-in contact terminal illustrating the invention and corresponding to the female contact terminal shown in FIG. 1.
Figure 3:
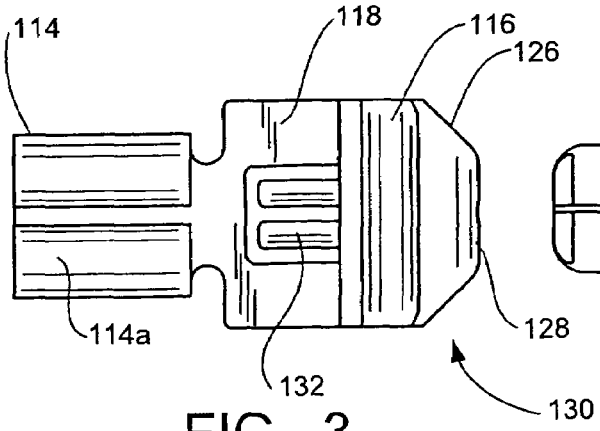
FIG. 3 is a top plan view of the female push-in contact terminal of FIG. 1.
Figure 4:
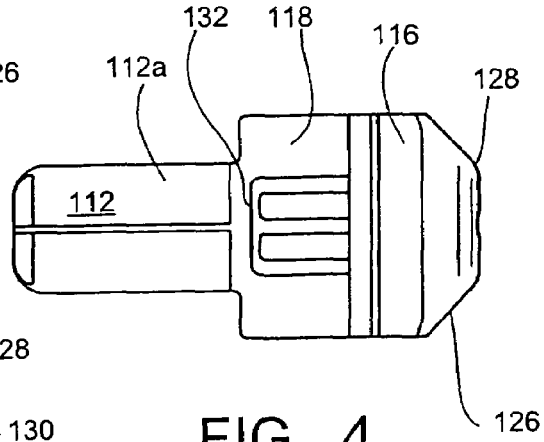
FIG. 4 is a top plan view of the male push-in contact terminal of FIG. 2.
Figure 5:
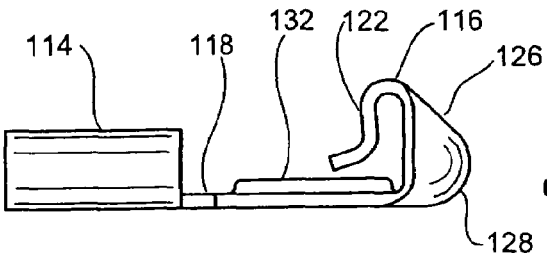
FIG. 5 is a side view of the female push-in contact terminal of FIG. 1.
Figure 6:
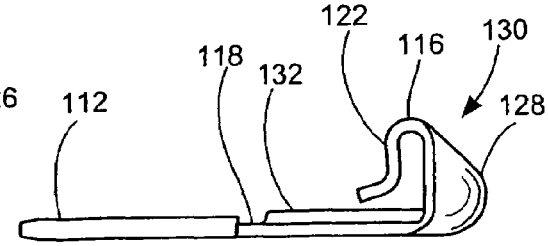
FIG. 6 is a side view of the male push-in contact terminal of FIG. 2.

DETAILED DESCRIPTION OF PREFERRED EMBODIMENT:

An electrical contact terminal 100 of the present invention is shown in the FIGS. 1-6. The contact terminal 100 may be a traditional male terminal 112 or a female terminal 114. These contact terminals are of the "push-in" variety and are often used in such electrical connectors as disconnects. The actual contact type can be formed in any well known configuration such as a spade, a ring, a ferrule or pin type contact. Alternate electrical connector component designs are also possible or such components may be employed in other types of electrical connectors such as an interconnect or a splice that is used to join a wire or cable to another or to an electrical device. The present invention is not limited to the type of electrical connector employed.

For simplicity of description, contact terminal 100 will be referred to where the components are identical with respect to male terminal 112 and female terminal 114.

In most electrical connector components of the type described above, the contact terminal is generally manufactured from a single piece of electrically conductive material. Such contact terminals are generally punched out from a larger sheet of material and then is rolled or bent or otherwise configured into the desired shape. It may be appreciated, however, that multi-component terminals may be employed in the present invention. As shown in the drawings, one typical shape incorporates a member 116 extending generally upright or cantilevered at an angle from a main body 118 of the contact terminal 100. This member 116 includes a wire opening 120 into which a wire 500 would be pushed or inserted as shown in FIGS. 7-10. Member 116 may also include some type of insulation displacement push-in device (not shown) that is used instead of wire opening 120 if that design is so desired. Such featured device is disclosed in the U.S. Pat. No. 4,455,057 to Mariani and the U.S. Pat. No. 4,461,527 to Izraeli, both of which are incorporated herein by reference.

In the embodiment shown, member 116 is configured with a reverse-bent retention member 122 that extends back towards main body 118. This reverse-bent retention member 122 retains the wire in compressive engagement against electrical contact terminal 100 in the normal fashion after such wire is pushed through opening 120. Although in FIG. 9, the sharp distal edge of the retention member 122 grasps the wire by "digging-into" the wire portion, such design can take many different configurations.

Figure 7:
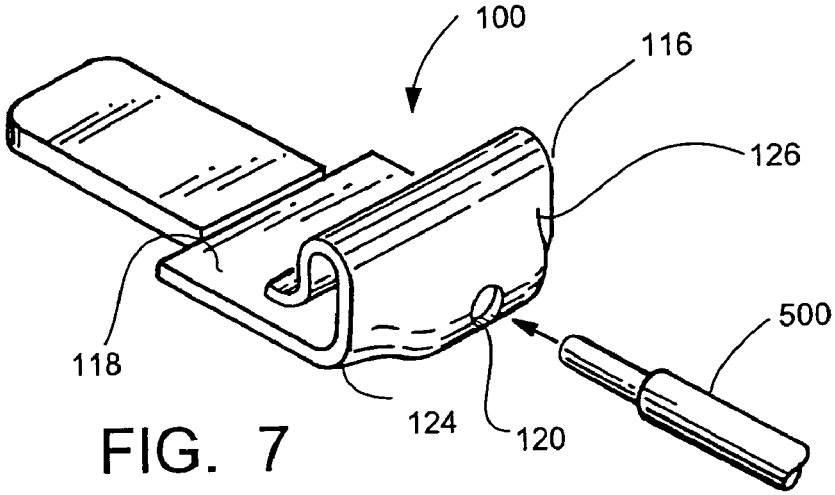
Figure 8:
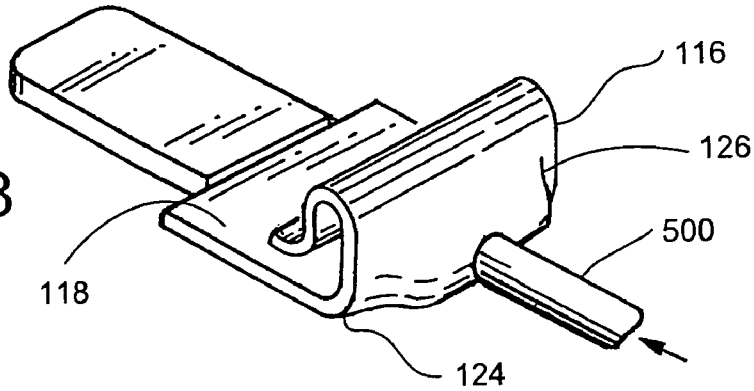
FIG. 8 is a perspective view of the male push-in contact terminal of FIG. 2 with a partial view of a wire being retained therein.
Figure 9:
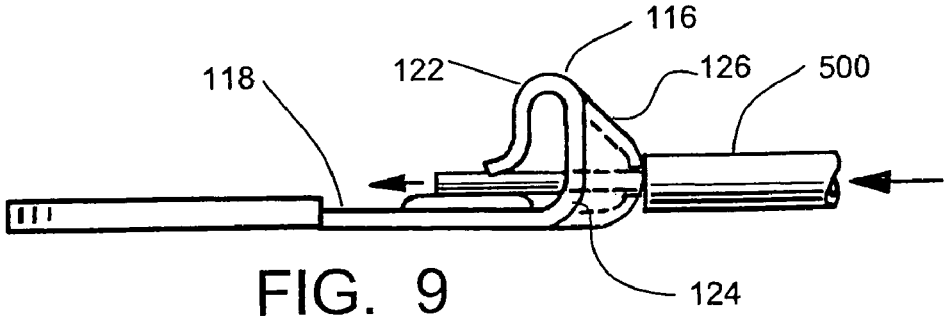
FIG. 9 is a side view of the male push-in contact terminal of FIG. 2 with a partial view of a wire being retained therein.

As a withdrawal force is applied to the wire in a direction opposite to the direction of the arrow, shown in FIGS. 7-9, the generally 90 degree bend or corner 124 between member 116 and main body 118 will be flexed. Any such flexing will increase the angle of this bend 124 thereby significantly altering the angle at which reverse bent retention member 122 engages the wire. Any slight variation of this angle may permit the wire to undesirably separate from electrical contact terminal 100. Similarly, the upstanding insulation displacement tab may be subject to a wire pull-out force.

The present invention therefore incorporates stiffener 126 or other type of strengthening rib or crimp adjacent corner 124. Stiffener 126 in this embodiment consists of an embossment in cantilevered member 116 which can be either concave or convex. As shown, push-in wire opening 120 is fully surrounded by such embossment 128. This embossment 128 helps strengthen member 116 and prevents it from flexing during a wire pull-out load. Stiffener 126 is intended to provide much greater rigidity to cantilevered member 116 than is possible from bend 124 which is generally just a simple 90 degree bend. Because member 116 is now strengthened or stiffened and less likely to flex under a wire pull-out load, the wire is more securely mechanically attached to electrical contact terminal 100.

While a single rather large embossment 128 is presently shown, it is also conceivable for embossment 128 to take the shape of one or more smaller bulges along bend 124. Stiffener 126 can also consist of one or more crimps along corner 124, the purpose here being to strengthen cantilevered member 116 and make it more rigid and less likely to flex when subject to a wire withdrawal force. This will ensure that the wire remains attached to contact terminal 100 during repeated connections and disconnections and especially if the wire is connected to the contact terminal via the method of attachment shown here that employs reverse bent retention member 122.

Such stiffener 126, and especially embossment 128, may be readily stamped into the contact terminal during manufacturing. Alternatively, it is possible to add additional material to corner 124 to make this corner more rigid and less likely to deflect or deform. The preferred embodiment is to create such rigidity using the contact terminal material itself, such as via stamping or crimping. Thus the wire is both in electrical as well as mechanical contact with electrical contact terminal 100.

Wire receiving region 130 is also shown incorporating wire guide 132 in FIGS. 3-6. In this embodiment, wire guide 132 consists of a pair of elongated ribs that extend along and on opposite sides of the wire that is pushed or inserted through wire opening 120 as shown in FIGS. 7-9. These ribs help retain the wire under retention member 122 and thus in electrical and mechanical engagement with the contact. Also, wire opening 120 can be configured to accept a variety of different wire gauges but it is expected that, more often, the wire opening 120, would be designed to receive smaller wires, such as a wire ranging between 12-18 gauges. Preferably, the present invention may also be configured to receive a different range of wires, for instance, from between 14 to 12 gauge for a range of flexible uses.

In many cases, wire receiving region 130 of electrical contact terminal 100 will be surrounded by vinyl or nylon or another insulating material. It may also be desirable to enclose the entire contact terminal in insulating material so as to avoid any short-circuiting. Typically, such insulating material can be molded of thermoplastic material which provides good electrical insulation. A manufacturer may also desire to join or combine several such contacts into a single electrical connection. All of these steps or combinations are common in the industry and fully contemplated herein.

In particular, FIGS. 11-16 show a dielectric female housing segment 420 and a dielectric male segment 440 configured to join together as a modular dielectric housing 400 surrounding two pairs of crimp-style contact terminals 300. Each of these dielectric housing segments in turn includes of a front housing unit (422, 442) and a rear housing unit (424, 444). The modular configuration allows the modular dielectric housing 400 to be assembled in the field. Although the drawings show the housing 400 being used with a set of crimp style contact terminals 300 having either a male or a female contact, the push-in style contact terminals 100 mentioned above or a spade, a ring or even a ferrule or pin type contact style terminals can be used instead.

Figures 11, 12, 13, 14, 15, 16:
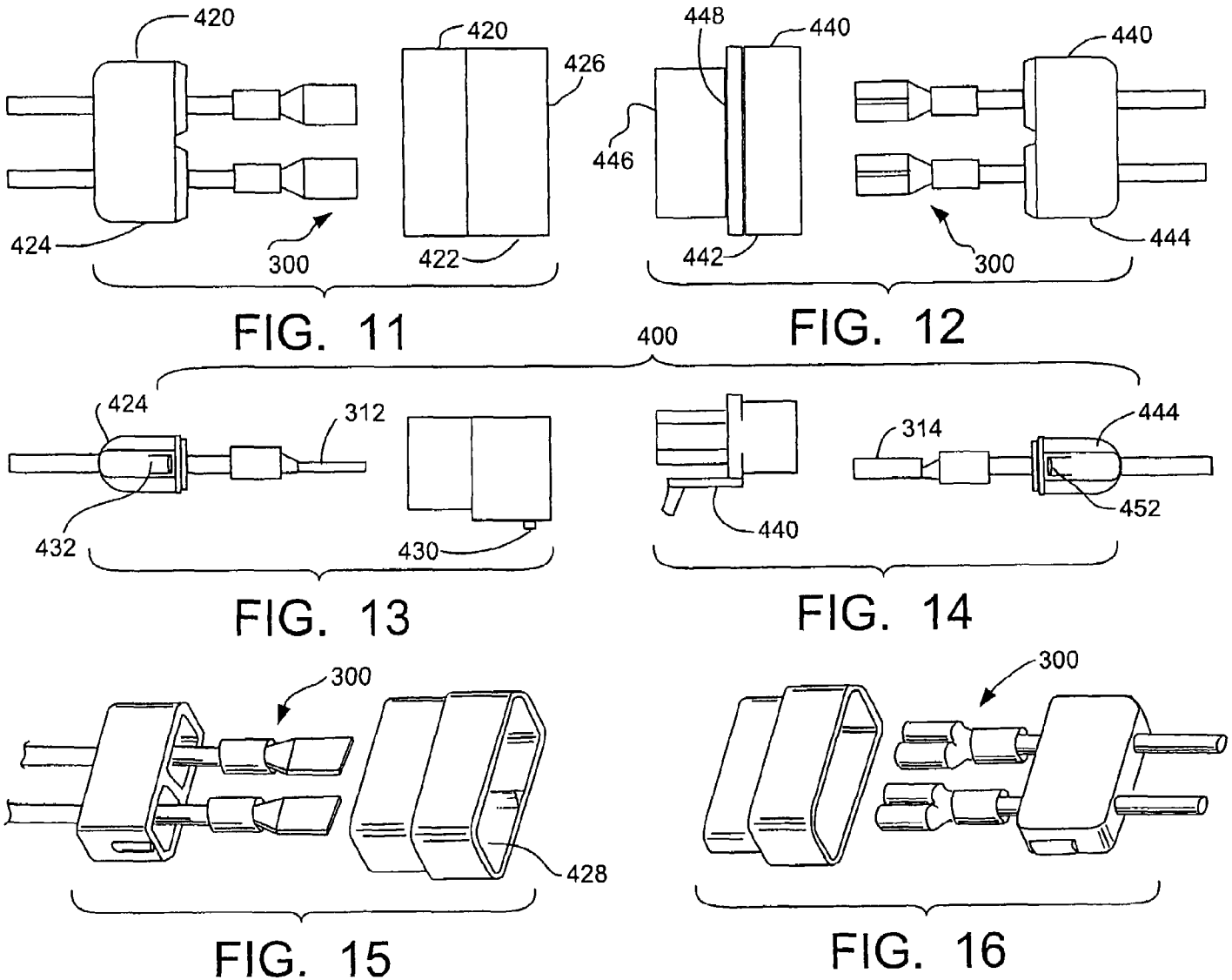
FIG. 11 is an exploded top view of a female housing segment illustrating the invention.
FIG. 12 is an exploded top view of a male housing segment illustrating the invention and corresponding to the female housing segment shown in FIG. 11.
FIG. 13 is an exploded side view of the female housing segment of FIG. 11.
FIG. 14 is an exploded side view of the male housing segment of FIG. 12.
FIG. 15 is an exploded perspective view of the female housing segment of FIG. 1.
FIG. 16 is an exploded perspective view of the male housing segment of FIG. 12.

Each front housing unit (422, 442) includes either a male 426 or a female disconnect interface 446. Although numerous housing interface styles exist such as a pin or a magnetic style, the drawings show disconnect interfaces consisting of a sleeve-shaped male plug 446 designed to slide into a corresponding female connector 426. Preferably, the male plug 446 may include a snap-in indentation (not shown) around the periphery of its sleeve-shape as well as a ledge 448 at a distance from the edge at which the tip of the female connector 426 may stop. In the alternative, as shown by FIGS. 13 and 14, the outer surface of the male and female segments may be designed with an integral latch (430, 440) to prevent accidental unplugging and to insure positive contact as well. Thus constructed, the modular housing 400 can be pushed in and snapped tight facilitating a quickly assembly in the field. Also, when an electrician needs to service a fluorescent luminary, s/he will then be able to easily unplug the disconnect interface (426, 446) to de-energize the ballast circuit.

Other safety features could enhance the electrical connection components. For example, FIG. 15 shows that the inner portion of the female plug includes a polarized wedge 428 to prevent mating of circuit of opposite polarity. Additionally, the housing can be color-coded, for instance in orange, for easy visibility and safety consideration.

While a male-female disconnect system (426, 446) is shown, it is also conceivable to supply one end of the disconnect interface with integral leads for termination directly to a ballast or for wiring into the ballast leads. Furthermore, although the inner modular interface mates the male 312 and female 314 crimp contact terminals, the push-in design can also be supplied without the terminals for direct termination of ballast leads and supply leads, or may use a pig-tail lead to connect to the supply leads.

Figure 10:
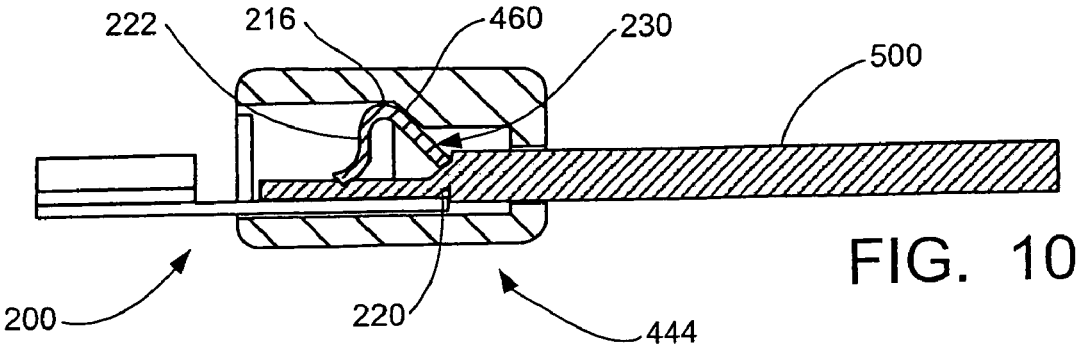
FIG. 10 is a side cutaway view of the female push-in contact terminal of FIG. 1 with a wire being retained therein.

As can be seen in FIGS. 13-14, the rear housing units 424, 444 are molded with side latches 432, 452 to snap-into the back end of the male or female contact housing units 422, 442. In a particular embodiment as shown in FIG. 10, inside each rear housing unit 444, an integral angled ledge 460 can be constructed to contact and confine a periphery section of the wire receiving region 230 for a push-in contact terminal 200. The push-in terminal 200 for this particular embodiment may include a member 216 which is slightly flexible at the bend unlike the contact terminal described above. Thus, as the wire 500 outside the contact terminal 200 is mishandled and tugged backward in a negative direction, the external load also pulls the area near the opening 220 as well. However, because the ledge 460 obstructs the periphery section of the opening 220 from being pulled back, the wire receiving region 230 flexes, enabling the retention member 222 to bear down on the wire to grasp it even more firmly. Thus constructed, the breaking point when the wire 500 is pulled under load, is not at the wire-terminal point, but at the housing interface instead.

Additionally, the rear housing unit 444 for the push-in style contact terminal 200 includes an integral strain-relief feature to help reduce force being translated to contact terminal 200 when an external force on wire 500 is applied. By this advantageous design, the push-in contact terminal 200 further enhances the quick assembly convenience feature of the modular dielectric housing 400 in the field. Even though the drawings depict a 2-pole connector component system, a person skilled in the art would immediately recognize that a 3-pole connector component system or any other numbered connector component system can be made as well.

While select preferred embodiments of this invention have been illustrated, many modifications may occur to those skilled in the art and therefore it is to be understood that these modifications are incorporated within these embodiments as if they were fully illustrated and described herein.

What is claimed is:

1. A contact terminal for an electrical connector comprising:

(a) a main contact body;

(b) a push-in wire connection portion of said main contact body cantilevered from said main contact body, said portion incorporating an insulation displacement device to receive a wire for electrical connection to the contact terminal;

(c) a stiffener adjacent the junction of said main contact body and said portion, said stiffener providing rigidity to said cantilevered portion.

2. The contact terminal as set forth in claim 1 wherein said main contact body is composed of a single unitary piece of electrically conductive material.

3. A contact terminal for an electrical connector comprising:

(a) a main contact body;

(b) a push-in wire connection portion of said main contact body cantilevered from said main contact body, said portion configured to receive a wire for mechanical and electrical connection to the contact terminal;

(c) a stiffener adjacent the junction of said main contact body and said portion, said stiffener providing rigidity to said cantilevered portion; wherein said stiffener comprises an embossment projecting outwardly away from said main contact body.

4. The contact terminal as set forth in claim 3 wherein said push-in type wire connection incorporates a wire retention member.

5. The contact terminal as set forth in claim 3, further comprises a wire guide integral to said main body for maintaining the wire against said wire retention member.

6. The contact terminal as set forth in claim 3, wherein said stiffener comprises one or more indentations at the junction of said main contact body and said portion.

7. The contact terminal as set forth in claim 3, wherein the contact terminal comprises a component of an electrical disconnect connector.

8. A modular connector component comprising:

(a) a contact terminal having a main contact body, an angled portion with an opening for a wire, and a reverse bent wire retention member; and (b) a dielectric housing segment enclosing at least a part of said contact terminal; and (c) another dielectric housing segment, said dielectric housing segments including a hermaphroditic interface designed to join together, wherein said wire retention member is configured to positively grip the wire with a force greater than a force of said hermaphroditic interface when the wire is pulled under a load.

9. The modular connector component according to claim 8, wherein said angled portion includes an embossed stiffener.

10. The modular connector component according to claim 8, wherein said housing includes an integral rear surface strain relief feature that redistributes force on said terminal to said housing when a withdrawal force is exerted on the wire.

11. The modular connector component according to claim 8, wherein said hermaphroditic interface is polarized to prevent mating of circuit of opposite polarity.

12. The modular connector component according to claim 8, wherein said dielectric segment is configured with a ballast interface to apply directly to a ballast.

13. The modular connector component according to claim 8, color coded for easy safety identification.

14. The modular connector component according to claim 8, wherein said housing includes a front housing unit and a rear housing unit configured with a tool-less snap-in feature to prevent accidental unplugging and insure positive contact.

15. The modular connector component according to claim 14, wherein said rear housing unit includes a ledge configured to press said contact terminal at a periphery region provided at a distance away from said opening.

* * * * *

UNITED STATES PATENT AND TRADEMARK OFFICE

CERTIFICATE OF CORRECTION

PATENT NO. : 7,470,143 B2
APPLICATION NO. : 11/656212
DATED : December 30, 2008
INVENTOR(S) : Osborn, Jr. et al.

It is certified that error appears in the above-identified patent and that said Letters Patent is hereby corrected as shown below:

On the cover page, item "(74) Attorney, Agent, or Firm - Hoffman & Baron, LLP"; should read --(74) Attorney, Agent, or Firm -Hoffmann & Baron, LLP--.

At column 2, line 52, reads "...housing segment of Fig. 1; and..."; should read --...housing segment of Fig. 11; and...--.

Signed and Sealed this

Twenty-fourth Day of March, 2009

JOHN DOLL
*Acting Director of the United States Patent and Trademark Office*